United States Patent [19]

Hatao et al.

[11] 4,424,513

[45] Jan. 3, 1984

[54] METHOD AND APPARATUS FOR CONTROLLING A DYNAMIC OR STATIC TYPE DIGITAL DISPLAY DEVICE

[75] Inventors: Itsuro Hatao; Susumu Kobayashi, both of Yokohama, Japan

[73] Assignee: Victor Company of Japan, Limited, Yokohama, Japan

[21] Appl. No.: 216,809

[22] Filed: Dec. 15, 1980

[30] Foreign Application Priority Data

Dec. 17, 1979 [JP] Japan ..... 54-174546[U]

[51] Int. Cl.[3] ..... G09G 3/04

[52] U.S. Cl. ..... 340/805; 340/717; 340/802; 340/798

[58] Field of Search ..... 340/716, 717, 805, 752, 340/802, 798, 756

[56] References Cited

U.S. PATENT DOCUMENTS

| | | | |
|---|---|---|---|
| 3,539,999 | 11/1970 | Houldin et al. | 340/717 |
| 4,257,045 | 3/1981 | Miles | 340/805 |
| 4,286,263 | 8/1981 | Lindberg | 340/717 |
| 4,325,062 | 4/1982 | Devlin | 340/717 |

*Primary Examiner*—Marshall M. Curtis

*Attorney, Agent, or Firm*—Lowe, King, Price & Becker

[57] ABSTRACT

A control apparatus for driving a digital display device of either a dynamic or static type is responsive to data from a switch indicating whether a dynamic or static type display device is to be driven. When a dynamic display device is to be driven, corresponding instruction data are read out from a first memory included in the control apparatus whereas when a static display device is to be driven, corresponding instruction data are read out from a second memory. A processing circuit operates in accordance with selected instruction data, and thus (a) time shared output signals indicative of data to be displayed are generated through a plurality of output terminals for driving the dynamic display device, or (b) a single output indicative of data to be displayed is generated through one of the output terminals so as to drive the static display device. When driving the static display device, a clock pulse signal and load-command signal are also generated through some of the output terminals to periodically convert the output data fed through a single line into a plurality of driving signals for static display.

7 Claims, 27 Drawing Figures

FIG. 5(A) Sa
H
L
TIME
FIG. 5(B) D1
H
L
1 2 3 4 5 6 7 8 9 10 11 12 13 14 15 16 17 18 19 20 21 22 23 24 25 26 27 28
TIME
FIG. 5(C) D2
H
L
TIME

CORRESPONDING SEGMENTS
a1 b1 c1 d1 e1 f1 g1 a2 b2 c2 d2 e2 f2 g2 a3 b3 c3 d3 e3 f3 g3 a4 b4 c4 d4 e4 f4 g4
FIRST FIGURE
SECOND FIGURE
THIRD FIGURE
FOURTH FIGURE
FIG. 5(E) DISPLAY
1
2
3
4

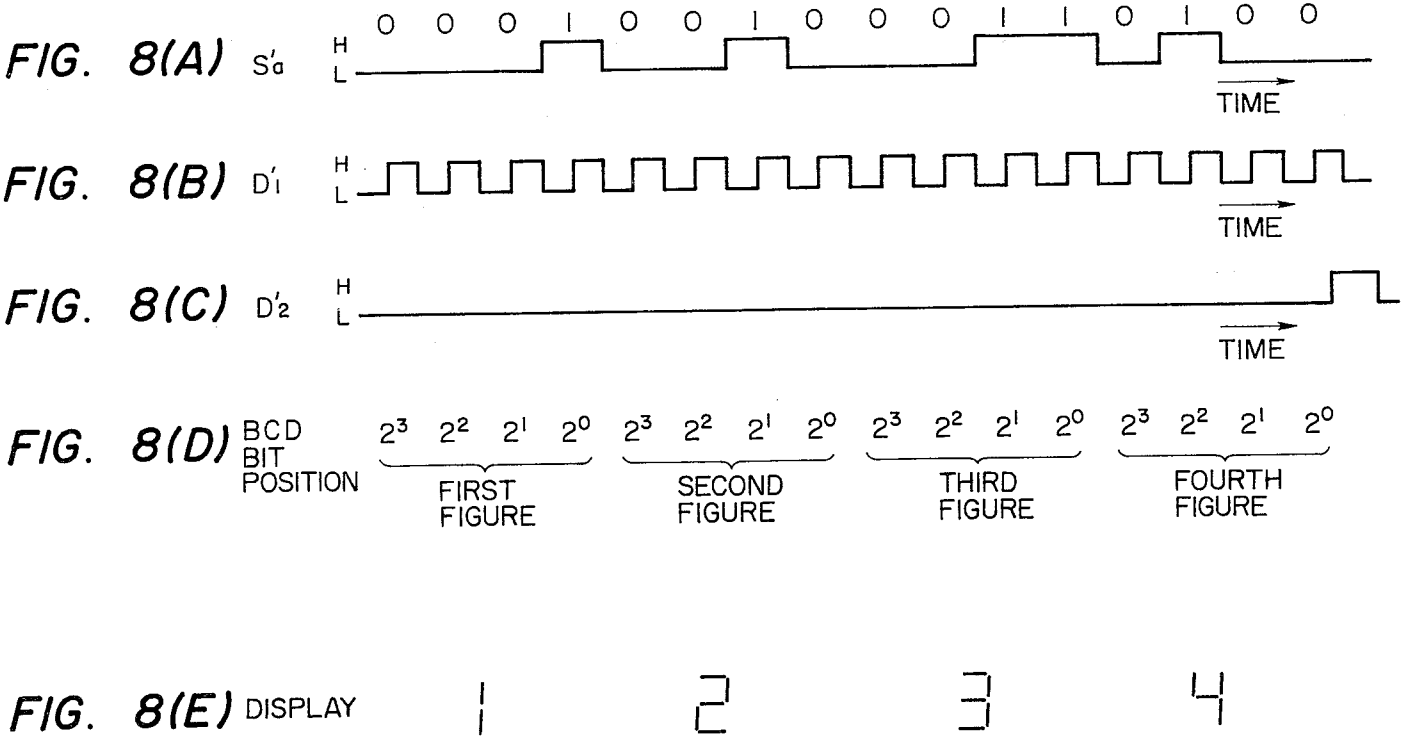
FIG. 8(A) S'a
H
L
0 0 0 0 1 0 0 0 0 1 1 0 1 0 0
TIME
FIG. 8(B) D'1
H
L
TIME
FIG. 8(C) D'2
H
L
TIME
FIG. 8(D) BCD BIT POSITION
2³ 2² 2¹ 2⁰
FIRST FIGURE
2³ 2² 2¹ 2⁰
SECOND FIGURE
2³ 2² 2¹ 2⁰
THIRD FIGURE
2³ 2² 2¹ 2⁰
FOURTH FIGURE
FIG. 8(E) DISPLAY
1
2
3
4

METHOD AND APPARATUS FOR CONTROLLING A DYNAMIC OR STATIC TYPE DIGITAL DISPLAY DEVICE

FIELD OF THE INVENTION

This invention generally relates to a method of and apparatus for controlling a digital display device, and more particularly, for driving a digital display device of either a dynamic display or static type.

BACKGROUND OF THE INVENTION

Two conventional methods for driving a digital display device are well known; one is static display in which static lighting-display is performed by applying a d.c. voltage; and the other is dynamic display in which digital display elements are lighted one after another in a sequence by periodically applying an a.c. voltage to digital display elements to provide the appearance of constant lighting using residual image effect of human eyes.

Although static display does not produce electromagnetic interference in theory, the circuit is complex because the number of driving circuits (control circuits) is large. On the other hand, although dynamic display is simple in construction because its driving circuits can be used in common, it has a drawback that electromagnetic interference is apt to occur.

As the above-mentioned driving or control circuits, microcomputer or large scale integrated circuitry (LSI) is often used presently. However, the control circuit per se has to be designed to produce a suitable output drive signal or current so that either dynamic or static drive is effected. To date, if the digital display device is of the dynamic type, an exclusive microcomputer or LSI for delivering dynamic display signal has been used; if the display is of the dynamic display type, an exclusive microcomputer or LSI for delivering static display signal has been used. Therefore, the type of digital display control circuit has had to be selected depending on the type of the digital display device to be driven thereby.

SUMMARY OF THE INVENTION

The present invention has been developed in order to remove the above-described disadvantage inherent to the conventional apparatus and method.

It is, therefore, an object of the present invention to provide a method of and apparatus for controlling a digital display device of either a dynamic or static display type with a single control circuit. The apparatus can be switched to either a dynamic drive mode, in which a plurality of multi-segment display units are driven sequentially, and a static drive mode, in which a plurality of multi-segment display units are driven simultaneously, so that one of dynamic display and static display is selectively effected.

Another object of the present invention is to provide a method of and apparatus for controlling a digital display device of either a dynamic or static display type with a single control circuit which may be a microcomputer or an LSI.

Another object of the present invention is to provide method and apparatus for controlling digital display device so that some or all of the output terminals of a single control circuit can be used in common for dynamic display and static display.

BRIEF DESCRIPTION OF THE DRAWINGS

These and other features of the present invention will become more readily apparent from the following detailed description of the preferred embodiments taken in conjunction with the accompanying drawings in which:

FIGS. 8 (A) to (C), and (D) and (E) are views respectively showing the digital signal waveforms and bit positions in BCD form for the description of the operation, and digital display.

DETAILED DESCRIPTION OF THE PREFERRED EMBODIMENTS

Figure 1:
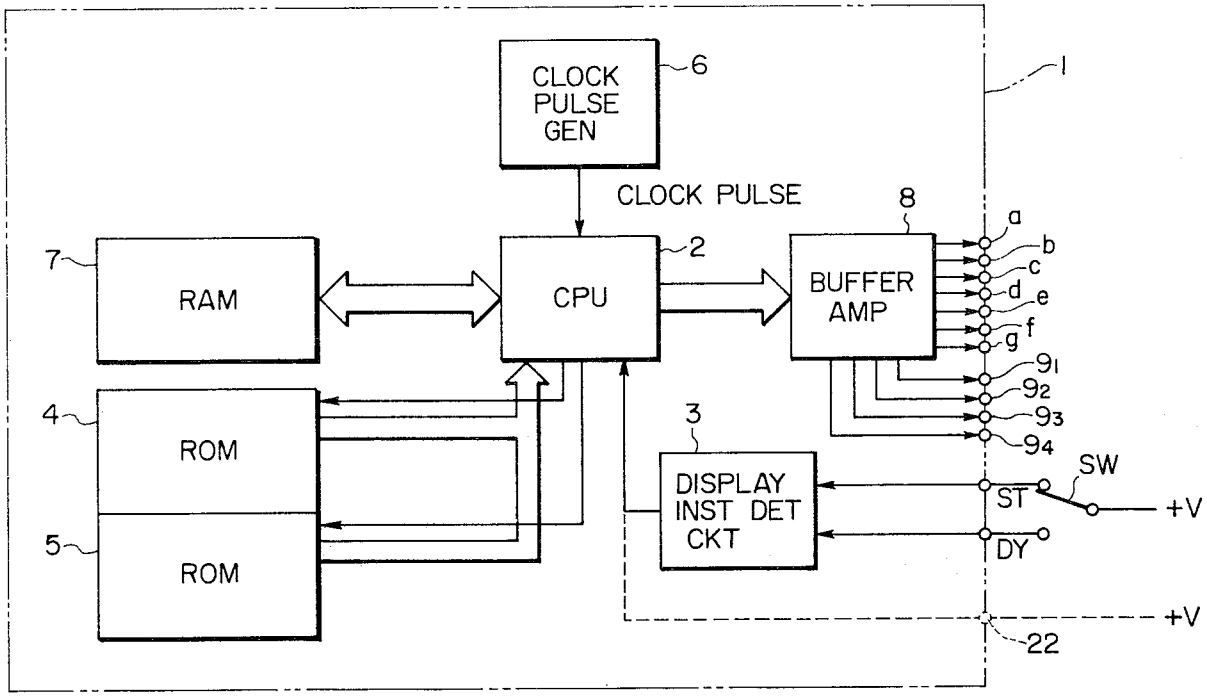
FIG. 1 is a block diagram showing an embodiment of a circuit according to the present invention.

FIG. 1 is a block diagram of an embodiment of an apparatus for controlling a digital display device, according to the present invention. In this embodiment a microcomputer is used as to constitute a control circuit 1 which generates a drive signal applied to a digital display device. In FIG. 1, the control circuit 1 is shown to be enclosed by a dot-dash line. In FIG. 1, numeral 2 identifies a central processing unit referred to as CPU which is supplied with the output signal of a display instruction detecting circuit 3. The display instruction detecting circuit 3 may be constructed of logic gates, and is arranged to produce logic "1" or "0" signal in accordance with its two input signals. The CPU 2 is controlled by the output signal of the display instruction detecting circuit 3 in such a manner that data prestored in one of read only memories (ROMs) 4 and 5 are selectively read out. The data stored in the ROM 4 are instructions for dynamic display, and the other data stored in the ROM 5 are instructions for static display.

A reference SW is a changeover switch, which is provided outside the control circuit 1, and is arranged to cause the control circuit 1 to emit data for static display if the movable contact of the changeover switch SW is in contact with a contact ST, and, to cause the control circuit 1 to emit data for dynamic display if the movable contact is in contact with a contact DY, where the movable contact is supplied with a given voltage +V.

Assuming first that the digital display device is of a dynamic display type, the changeover switch SW is operated so that the movable contact thereof is connected to the contact DY. As a result, a high level d.c.

voltage is applied via the changeover switch SW to the display instruction detecting circuit 3. Circuit 3 detects that dynamic display instruction is applied, and in response a detection signal, such as a logic "1" signal, is applied to the CPU 2. Thus, the CPU 2 controls the ROM 4 to read out the prestored data and a series of operations is performed thereafter.

Although it is shown, in FIG. 1, by means of a solid line that the output terminal of the display instruction detecting circuit 3 is connected to the CPU 2, the above-mentioned display instruction detecting circuit 3 and the changeover switch SW may be omitted if desired. In this case, a single terminal 22 directly connected to the CPU 2, as shown by a dotted line, is provided therefor. When dynamic display is to be performed, the terminal 22 is connected, as shown by another dotted line, to a power supply +V to receive a high level voltage (logic "1" signal) which functions as the above-mentioned detection signal. On the other hand, when static display is to be performed, the terminal 22 is disconnected from the power supply +V.

Provision of the above-mentioned switch SW is advantageous if the same control circuit 1 is to be used for both dynamic and static displays. However, a digital display control circuit is usually used for only one of dynamic or static displays, and the above-mentioned usage is very rare. Therefore, the above-mentioned changeover switch SW is not usually required, and the same effect is achieved by connecting the terminal 22 to the power supply +V to perform dynamic display and by disconnecting it from the power supply +V to perform static display or vice versa. The following description, however, is made assuming that the changeover switch SW and the display instruction detecting circuit 3 are employed.

Figure 3:
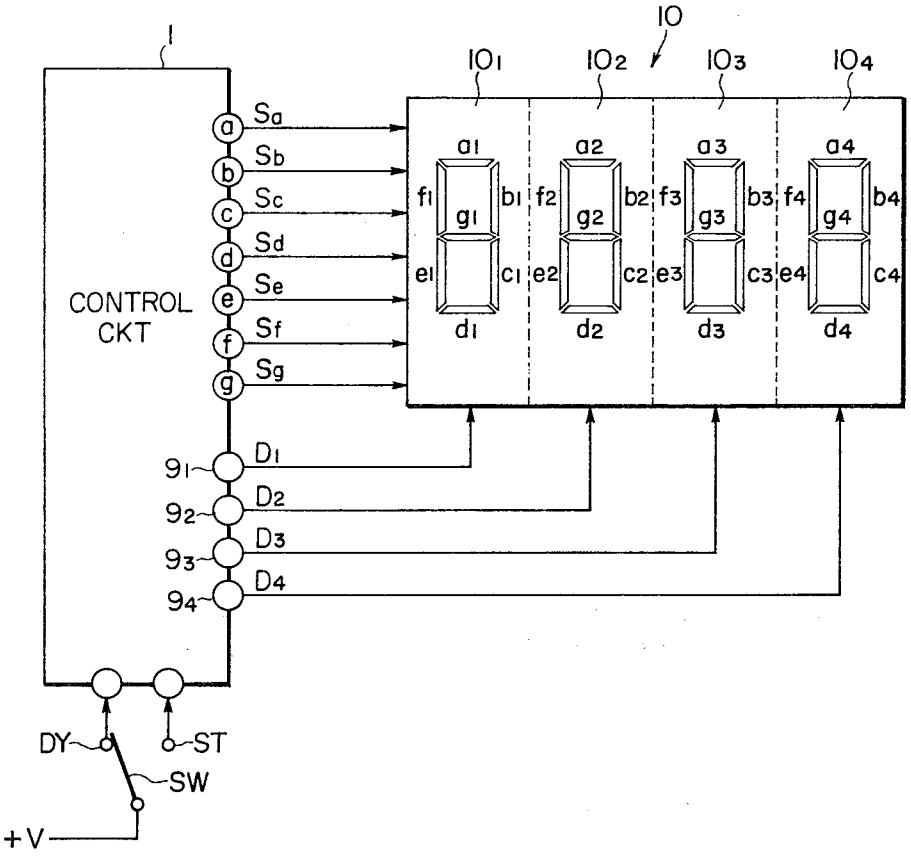
FIG. 3 is a block diagram showing an example of a structure for performing dynamic display with a digital display device by using a circuit according to the present invention.

Let us suppose that the digital display device for dynamic display (which will be referred to as dynamic display device hereinbelow) is a display device 10 of four figures comprising seven-segment numeral display elements $\mathbf{10}_1$, $\mathbf{10}_2$, $\mathbf{10}_3$, and $\mathbf{10}_4$ as shown in FIG. 3 as an example, and it will be described in connection with a case that it is intended to make the numeral display elements $\mathbf{10}_1$ to $\mathbf{10}_4$ display numerals "1", "2", "3" and "4" respectively.

Output terminals a to g of the control circuit 1, as shown in FIG. 3, are respectively connected to segments $a_1$ to $a_4$, $b_1$ to $b_4$, $c_1$ to $c_4$, $d_1$ to $d_4$, $e_1$ to $e_4$, $f_1$ to $f_4$, and $g_1$ to $g_4$ of the numeral display elements $\mathbf{10}_1$, $\mathbf{10}_2$, $\mathbf{10}_3$, and $\mathbf{10}_4$. Other output terminals $\mathbf{9}_1$, $\mathbf{9}_2$, $\mathbf{9}_3$, and $\mathbf{9}_4$ of the control circuit 1 are respectively connected to the numeral display elements $\mathbf{10}_1$, $\mathbf{10}_2$, $\mathbf{10}_3$, and $\mathbf{10}_4$. The numeral display elements $\mathbf{10}_1$ to $\mathbf{10}_4$ are arranged to emit light to display numerals only when high input level signals are fed from both the above-mentioned output terminals a to g and $\mathbf{9}_1$ to $\mathbf{9}_4$.

As the above-mentioned series of operations based on the readout of the prestored data from the ROM 4, first, a high level signal is emitted via a buffer amplifier 8 from the output terminal $\mathbf{9}_1$ for an interval defined by a clock pulse from a clock generator 6, which clock pulses are applied to the CPU 2 of FIG. 1. And simultaneously, data of the first figure in a random access memory (RAM) 7 are read out by the CPU 2, and then delivered simultaneously via the CPU 2 and the buffer amplifier 8 to the corresponding output terminals a to g. Since it has been assumed that a numeral "1" is displayed at the first figure, "0", "1", "1", "0", "0", "0", "0" (wherein "0" is low level, and "1" is high level) are respectively delivered to the output terminals a, b, c, d, e, f, and g.

Next, a high level signal is delivered to the output terminal $\mathbf{9}_2$, and simultaneously the data of the second figure in the RAM 7 (that is 1101101 here) are read out, and are emitted to the corresponding output terminals a to g. After that, similar operations are repeated so that pulses are delivered to the output terminals $\mathbf{9}_1$, $\mathbf{9}_2$, $\mathbf{9}_3$ and $\mathbf{9}_4$ one after another as indicated by $D_1$, $D_2$, $D_3$ and $D_4$ in FIGS. 2 (H), (I), (J) and (K). On the other hand, to the output terminals a to g pulses indicated by $S_a$, $S_b$, $S_c$, $S_d$, $S_e$, $S_f$, and $S_g$ in FIGS. 2 (A), (B), (C), (D), (E), (F) and (G) are applied so that the display will be repeated as "1"→"2"→"3"→"4"→"1"→ . . . , as shown in FIG. 2 (L), one after another, time shared.

Construction of the dynamic display device 10 of FIG. 3 with a generally used fluorescent display tubes, as is well known, involves the seven segments of each numeral display element $\mathbf{10}_1$ to $\mathbf{10}_4$ being respectively disposed on anodes, and segments $a_1$ to $a_4$ are commonly connected to the terminal a. In the same manner, respective segments $b_1$ to $b_4$, $c_1$ to $c_4$, $d_1$ to $d_4$, $e_1$ to $e_4$, $f_1$ to $f_4$, and $g_1$ to $g_4$ are commonly connected and are connected to the terminals b, c, d, e, f, and g, while the numeral display elements $\mathbf{10}_1$ to $\mathbf{10}_4$ are provided with independent grids which are respectively connected to the terminals $\mathbf{9}_1$ to $\mathbf{9}_4$ correspondingly.

Figures 2A, 2B, 2C, 2D, 2E, 2F, 2G, 2H, 2I, 2J, 2K, 2L:
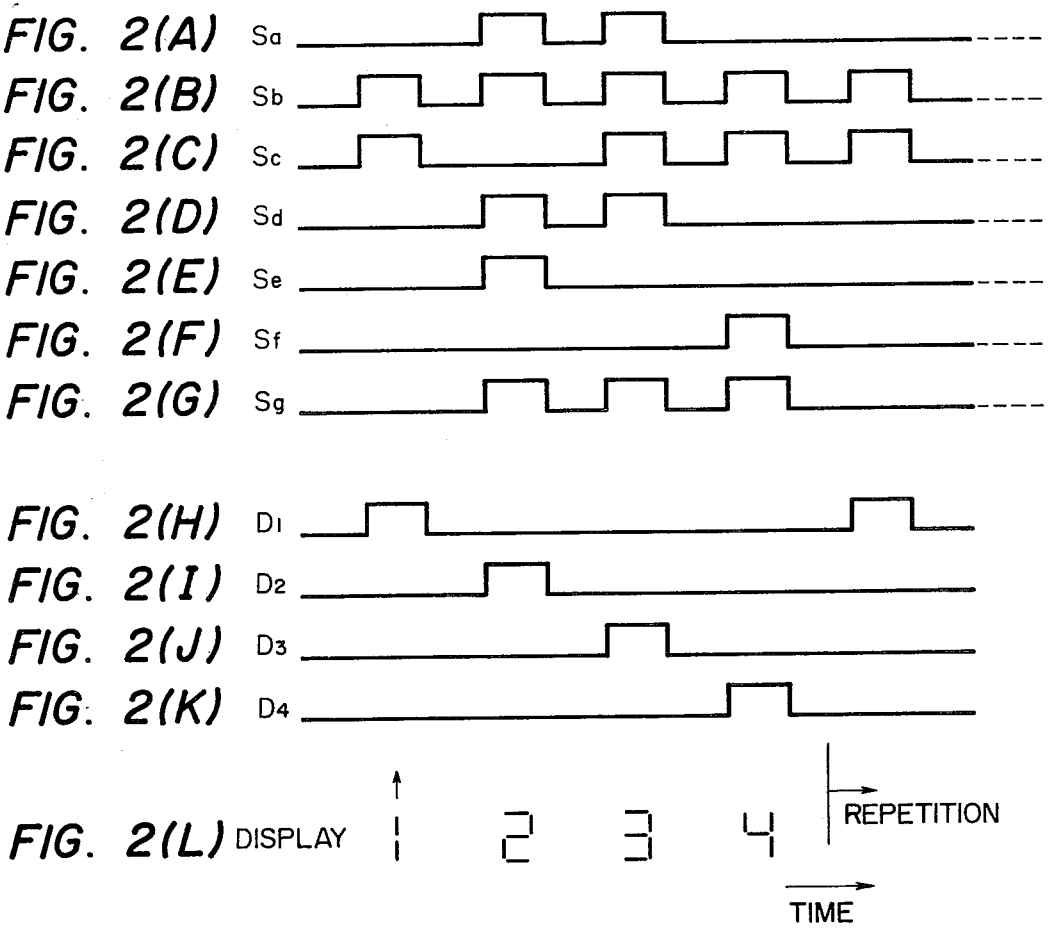
FIGS. 2 (A) to (K) and (L) are views respectively showing the digital signal waveforms for performing dynamic display as an example of the present invention and the display thereby.

With this arrangement, when the pulses such as shown in FIGS. 2 (A) to (K), are emitted, the grid of the numeral display element $\mathbf{10}_1$ of the first figure first becomes high, while the inputs of the segments $b_1$ and $c_1$ become high, so that the segments $b_1$ and $c_1$ emit light to display "¦". In the same manner, after that, the numeral display elements of respective figures emit light one after another so that dynamic display using the residual image effect of eyes is performed.

Figure 4:
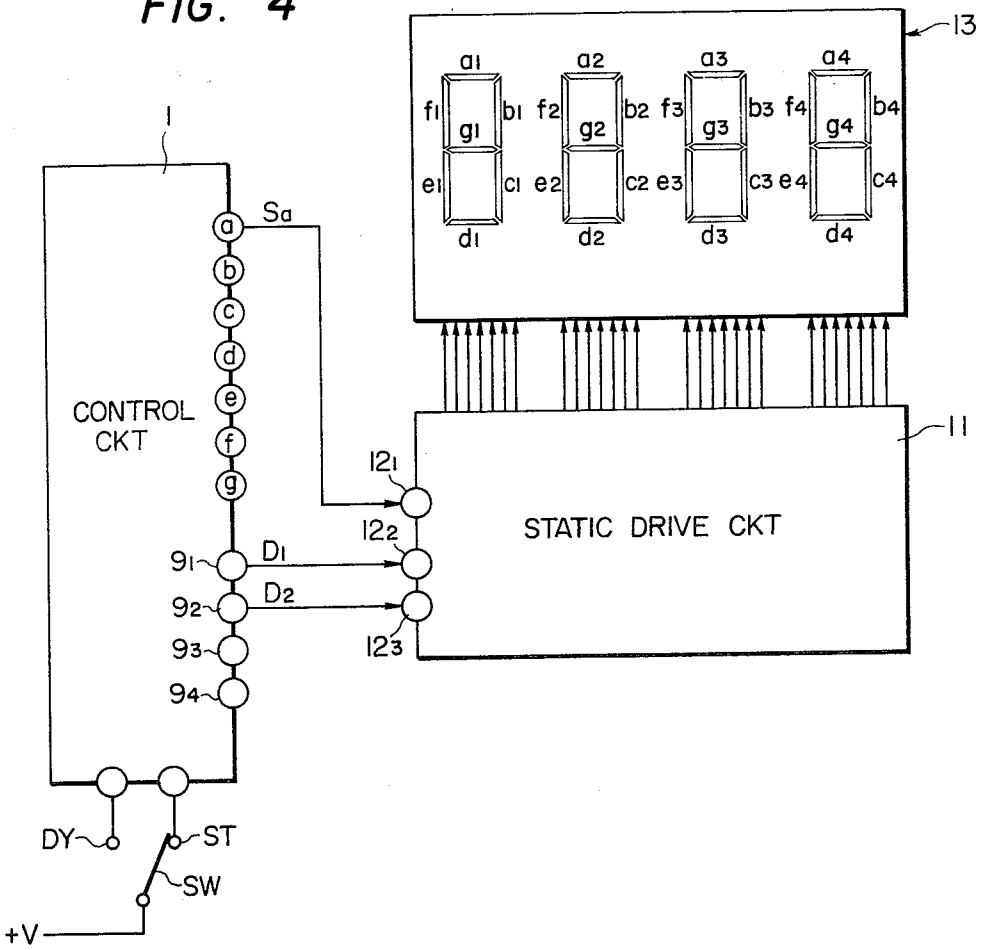
FIG. 4 is a block diagram showing an example of a structure for performing static display with a digital display device by using the circuit according to the present invention.

If the digital display device is of a static display type, the changeover switch SW is operated so that the movable contact thereof is in contact with a contact ST. On the other hand, the output terminal a of control circuit 1 is, as shown in FIG. 4, connected to a data input terminal $\mathbf{12}_1$ of a static drive circuit 11, while the output terminals $\mathbf{9}_1$ and $\mathbf{9}_2$ are respectively connected to a clock input terminal $\mathbf{12}_2$ and to a load-command pulse input terminal $\mathbf{12}_3$ of the static drive circuit 11.

If the digital display device (static display device) 13 for performing static display is of four figures, and each numeral display element making one figure has seven segments, the static drive circuit 11 emits a display signal through 28 lines as a total to the respective corresponding segments. When contructing the above-mentioned static display device 13 with fluorescent display tubes, the segments of each numeral display element are disposed on anodes, and a grid is arranged to maintain a high level where the grid is common for the four figures. Accordingly, the segments selectively emit light in accordance with the voltages applied to the segments of the numeral display elements.

With the movable contact of the changeover switch SW situated at the contact ST, a high level d.c. voltage is applied via a line connected to the contact ST to the display instruction detecting circuit 3 shown in FIG. 1, and the static display instruction is detected therein, the detection signal, such as a logic "0" signal, is applied to the CPU 2 so that the CPU 2 controls the ROM 5 to read out the prestored data, and a series of operations is started.

Figure 5D:
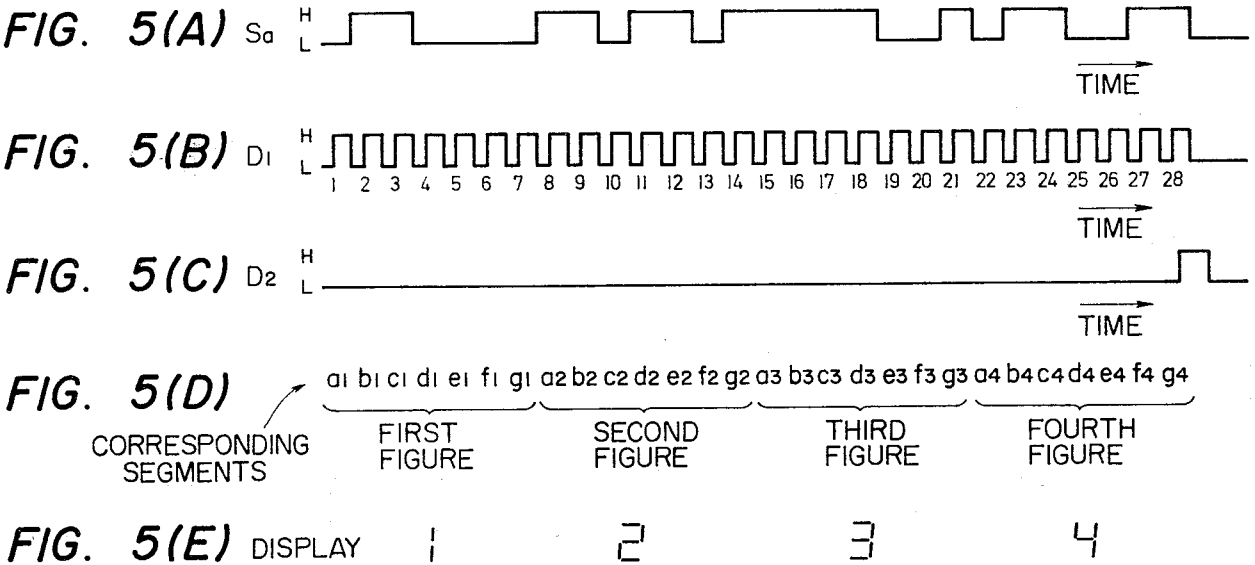
FIGS. 5 (A) to (C), and (D) and (E) are views respectively showing the digital signal waveforms for performing static display as an example of the present invention and corresponding segments, and the digital display thereby.

The particular operations are dependent on the structure of the static drive circuit 11, and let us take an example. First, among the prestored data in the RAM 7 to be applied to the respective segments $a_1$ to $g_1$, $a_2$ to $g_2$, $a_3$ to $g_3$, and $a_4$ to $g_4$ of the static display device 13, data are read out in a sequence, with which the data are applied to $a_1$, $b_1$, $c_1$, $d_1$, . . . $g_1$, $a_2$, $b_2$, . . . $f_4$, $g_4$ one bit by one bit respectively for a given period of time, and are delivered via the CPU 2 and the buffer amplifier 8 to the output terminal a. FIG. 5 (A) shows an example of the output pulse signal (data signal) $S_a$ at the output terminal a of the control circuit 1 at this time, while segments corresponding to the output pulse signals are shown in FIG. 5 (D).

In addition, clock pulses $D_1$, as shown in FIG. (B), which are obtained by dividing the frequency of the clock pulses from the clock generator 6 of FIG. 1, are derived with the corresponding timing from the output terminal $9_1$ to be applied to the input terminal $12_2$ of the static drive circuit 11. The clock pulses $D_1$ are arranged to correspond to one state of a datum at each leading edge thereof.

A pulse $D_2$, which becomes high, as shown in FIG. 5 (C), after 28 data and clock pulses in total are delivered, as delivered from the output terminal $9_2$ of the control circuit 1 to be applied to the input terminal $12_3$ of the static drive circuit 11 as a load-command pulse.

Figure 6:
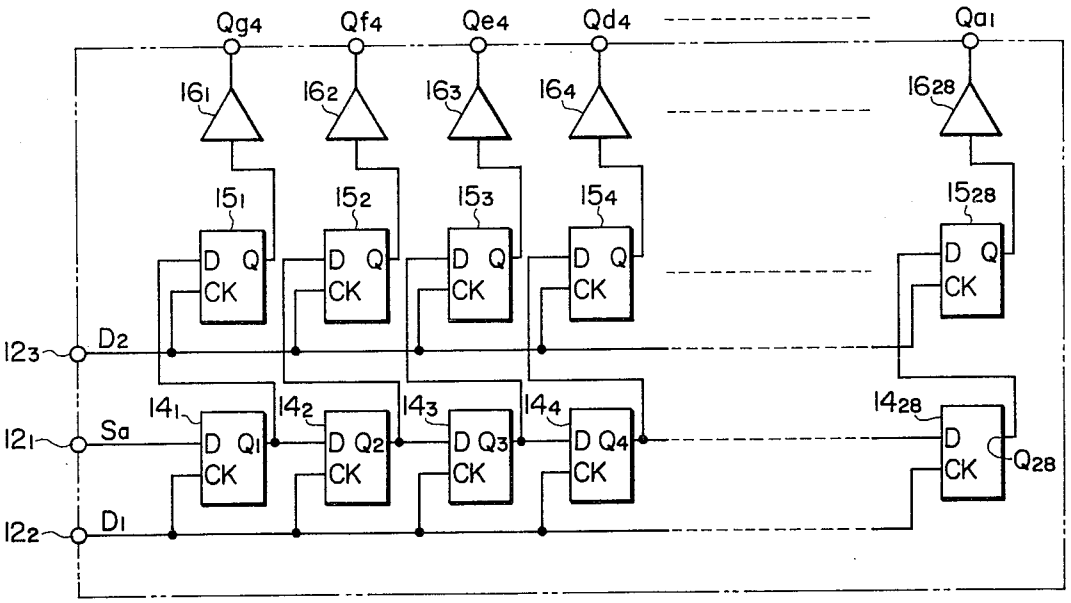
FIG. 6 is a circuit diagram showing the first embodiment of the static drive circuit of FIG. 4.

FIG. 6 shows a circuit diagram of a first embodiment of the static drive circuit 11. In FIG. 6, the input terminal $12_1$ is connected to a D input terminal of a D flip-flop $14_1$ which constitutes a 28-bit shift register having a series connection of D flip-flops $14_1$ to $14_{28}$. The input terminal $12_2$ is commonly connected to respective clock pulse input terminals CK of the above-mentioned flip-flops $14_1$ to $14_{28}$. Furthermore, the input terminal $12_3$ is commonly connected to respective clock pulse input terminals CK of D flip-flops $15_1$ to $15_{28}$ which constitute a 28-bit latch. Furthermore, $Q_i$ output terminals of the flip-flops $14_i$ (i=1, 2, . . . 28) are connected to D input terminals of the flip-flops $15_i$. The Q output terminals of the flip-flops $15_i$ are connected to buffer amplifiers $16_i$.

The operation of the above-mentioned circuit is described hereinbelow. The data signal $S_a$ of FIG. 5 (A) applied to the input terminal $12_1$ is in turn applied to the D input terminal of the flip-flop $14_1$. At each occurrence of the leading edge of the pulse $D_1$ of FIG. 5 (B) applied from the input terminal $12_2$ to the clock pulse input terminals CK of the flip-flops $14_1$ to $14_{28}$, the data signal $S_a$ is transferred rightward one after another. When 28 data are all stored in the outputs $Q_1$ to $Q_{28}$ of the flip-flops $14_1$ to $14_{28}$, the data are latched (stored) in the flip-flops $15_1$ to $15_{28}$ at the time of occurrence of the leading edge of the load-command pulse $D_2$ shown in FIG. 5 (C). The stored data of the flip-flops $15_1$ to $15_{28}$ are maintained until a next load-command pulse comes to the input terminal $12_3$, and thus the stored data are delivered via the buffer amplifiers $16_1$ to $16_{28}$ from the output terminals $Q_{g4}$, $Q_{f4}$, $Q_{e4}$, $Q_{d4}$, . . . $Q_{a1}$. This means that the serial data have been converted into a static display signal. The output terminals $Q_{g4}$, $Q_{f4}$, $Q_{e4}$, $Q_{d4}$, . . . , $Q_{a1}$ are respectively connected to the segments $g_4$, $f_4$, $e_4$, $d_4$ . . . , $a_1$ of the static display device 13. In this manner, static display of "1234" is achieved as shown in FIG. 5 (E).

Figure 7:
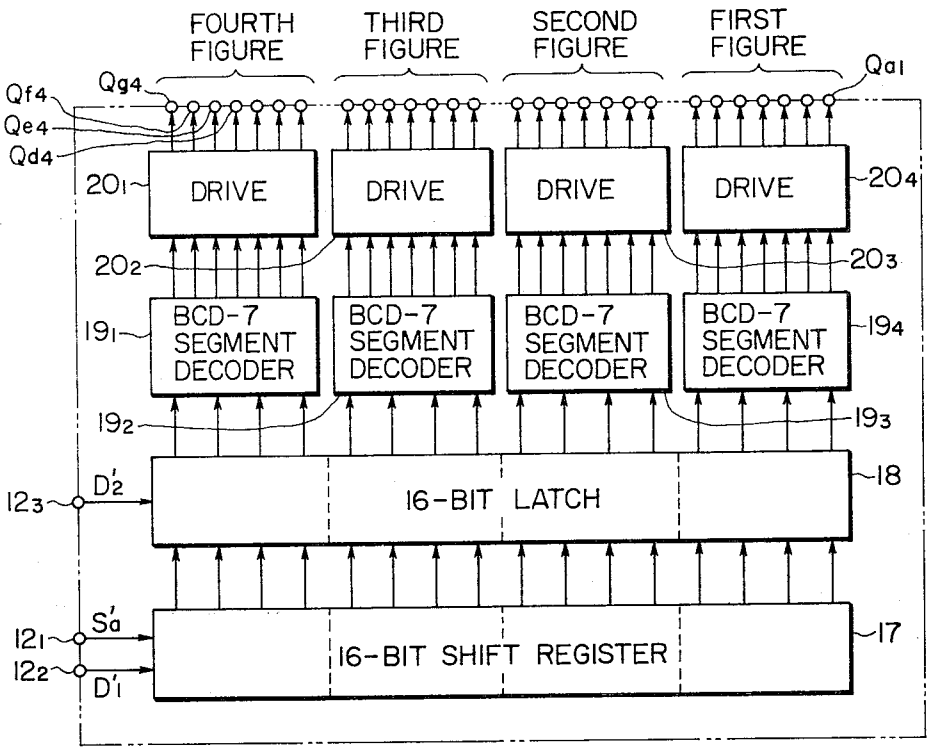
FIG. 7 is a circuit diagram of the second embodiment of the static drive circuit of FIG. 4.

The above is an example of the case that the data signals $S_a$ are emitted as data, with which the seven-segment numeral display elements can immediately display, but in case the data signals are emitted in BCD form, the static drive circuit 11 is constructed as shown in FIG. 7.

FIG. 7 is a circuit diagram of a second embodiment of the static drive circuit 11, and the same elements as in FIG. 6 are designated at like numerals. In FIG. 7, a data signal $S'_a$ of BCD derived from the output terminal a of the above-mentioned control circuit 1 is applied from the input terminal $12_1$ to a 16-bit shift register 17, and is taken in one bit by one bit at each time of occurrence of the leading edge of the clock pulse $D_1$ applied from the input terminal $12_2$ to the 16-bit shift register 17, so as to be shifted rightward. Assuming that it is intended to display "1" at a numeral display element (first figure) of the left most side in the above-mentioned static display device 13, and "2" at the second figure, "3" at the third figure, and "4" at the fourth figure, the above-mentioned data signal $S'_a$ changes its waveform as 0001001000110100 in BCD form corresponding to the BCD bit positions shown in FIG. 8 (D), and thus the data signal $S'_a$ takes a form of a pulse signal shown in FIG. 8 (A). Meanwhile, the clock pulses $D'_1$ are as shown in FIG. 8 (B), and the data signal $S'_a$ is fetched in the 16-bit shift register 17 at the time of the leading edge of each clock pulse. The load-command pulse $D'_2$ is as shown in FIG. 8 (C), and the parallel output data of the 16-bit shift register 17 are latched in the 16-bit latch 18 at the time of the leading edge thereof.

The 16-bit stored data derived from the 16-bit latch 18 are applied to BCD/seven-segment decoders $19_1$ to $19_4$ corresponding to respective figures, and then the BCD signal for each figure is converted into a coded signal which is suitable for a seven-segment numeral display element, and then delivered via corresponding drive circuits $20_1$ to $20_4$ to the output terminals $Q_{g4}$, $Q_{f4}$, $Q_{d4}$, $Q_{d4}$, . . . , $Q_{a1}$. Numerals "1234" as shown in FIG. 8 (E) are displayed at first to fourth figure places in the manner of static display also in this embodiment.

As described in the above, the control circuit 1 of the present embodiment is advantageous especially when formed in an integrated circuit because the number of output terminals can be reduced compared to the conventional circuits, that is, the output terminals, a, $9_1$ and $9_2$ among the output terminals a to g and $9_1$ to $9_4$ can be used in common without separately providing output terminals for static display and output terminals for dynamic display respectively, where it is only required to switch the changeover switch SW.

Although it has been described above, that the control circuit 1 supplies the static drive circuit 13 with serial data $S_a$ or $S'_a$, it is possible that a plurality of bits data can be emitted in parallel to be applied to the static drive circuit 11 by using a given number of a plurality of output terminals among a to g. In case data are emitted in the form of binary signals, data of 14 bits are emitted from the control circuit for displaying four figures. Furthermore, the numerals to be displayed can be varied by designating the readout address of the RAM 7 of FIG. 1 by manipulating an external key. However, if desired, the numerals to be displayed can be varied by directly applying a signal from an external key to the CPU 2.

As described in the above, since the display control circuit of a digital display device according to the present invention comprises a control circuit for generating and delivering a digital signal for displaying data or the like to be displayed by a digital display circuit. A changeover switch selects and delivers one of a digital signal for dynamic display and a digital signal for static display by using some or all of the output terminals of said control circuit in common after changing the circuit arrangement of said control circuit by applying an external signal via the switch or other source outside the control circuit. The invention has many advantages such that the number of output terminals can be reduced compared to conventional circuits so that the size of the circuit can be made small when formed in an integrated circuit, while the cost can also be reduced. When formed in an integrated circuit, if the number of terminals is the same as in the conventional circuit, further functions may be added because the number of input/output terminals for other functions can be increased. Since two kinds of output signals respectively for dynamic display and for static display can be obtained with a single integrated circuit, the circuit can be used if the digital display device is either of the above-mentioned two types so that the application range with respect to digital display device can be widened. When the above-mentioned control circuit is constructed of an integrated circuit or a microcomputer, the development cost for respectively developing control circuits for dynamic display and for static display can be reduced by one-half.

The above-described circuits according to the present invention are just examples of the invention, and therefore, it will be apparent for those skilled in the art that many modifications and variations may be made without departing from the spirit of the present invention.

What is claimed is:

1. An apparatus for producing selectively one of a dynamic drive signal and a static drive signal in response to a selection signal so that a digital display device having a plurality of multi-segment display units can be driven selectively in either (1) a dynamic drive mode, in which said plurality of multi-segment display units are driven sequentially, or (2) a static drive mode, in which said plurality of multi-segment display units are driven simultaneously, said circuit arrangement comprising:

(a) first memory means for storing data to be displayed;

(b) second memory means for storing operational instructions for producing said dynamic drive signal on the basis of data read out from said first memory means;

(c) third memory means for storing operational instructions for producing said static drive signal on the basis of data read out from said first memory means;

(d) a manually operable switch and an associated circuit for producing said selection signal;

(e) control means for reading out data from said first memory means in response to said selection signal, said control means processing said data in accordance with said operational instructions read out from said second memory means for producing said dynamic drive signal including a plurality of parallel data signals each having information for energizing a segment of each of said plurality of multi-segment display units when said selection signal assumes a predetermined level, said dynamic drive signal also including parallel timing signals with which each of said multi-segment display units is periodically energized; said control means processing said data in accordance with said operational instructions read out from said third memory means for producing said static drive signal including at least one serial data signal having information of a plurality of figures to be displayed by said plurality of multi-segment display units when said selection signal assumes another predetermined level, said static drive signal also including a timing signal for decoding said serial data signal so that each segment of each of said multi-segment display units is selectively energized in accordance with said serial data signal; and (f) a plurality of output terminals from which said dynamic drive signal and said static drive signal are selectively derived in such a manner that some of said output terminals are used in common for both signals of said dynamic drive signal and signals of said static drive signal.

2. Apparatus for controlling a digital display device as claimed in claim 1, wherein said control means comprises a microcomputer having a central processing unit, and first and second read only memories respectively functioning as said second and third memory means.

3. Apparatus for controlling a digital display device as claimed in claim 2, wherein said microcomputer further comprises a clock pulse generator for supplying said central processing unit with timing pulses.

4. Apparatus for controlling a digital display device as claimed in claim 2, wherein said microcomputer further comprises a display instruction detecting circuit including logic gates, said control means being responsive to said selection signal for supplying said central processing unit with a logic signal indicating whether dynamic or static display is intended.

5. Apparatus for controlling a digital display device as claimed in claim 2, wherein said microcomputer further comprises a random access memory for supplying said central processing unit with data to be displayed.

6. Apparatus for controlling digital display device as claimed in claim 2, wherein said microcomputer further comprises buffer amplifiers responsive to output data of said central processing unit, the outputs of said buffer amplifiers being connected to plurality of output terminals of said apparatus.

7. A method for producing selectively one of a dynamic drive signal and a static drive signal in response to a selection signal so that a digital display device having a plurality of multi-segment display units can be driven selectively in either (1) a dynamic drive mode, in which said plurality of multi-segment display units are driven sequentially, or (2) a static drive mode, in which said plurality of multi-segment display units are driven simultaneously, said method comprising the steps of:

(a) detecting the state of said selection signal for determining which of said dynamic drive signal and said static drive signal is to be produced;

(b) reading out data from a memory in response to said selection signal;

(c) processing said data for producing said dynamic drive signal including a plurality of parallel data signals, each having information for energizing a segment of each of said plurality of multi-segment display units when said selection signal assumes a predetermined level, said dynamic drive signal also including parallel timing signals with which each of said multi-segment display units is periodically energized;

(d) processing said data for producing said static drive signal including at least one serial data signal having information of a plurality of figures to be displayed by said plurality of multi-segment display units when said selection signal assumes another predetermined level, said static drive signal also including a timing signal for decoding said serial data signal so that each segment of each of said multi-segment display units is selectively energized in accordance with said serial data signal; and (e) transmitting said dynamic and static drive signals to a plurality of output terminals from which said dynamic drive signal and said static drive signal are selectively derived in such a manner that some of said output terminals are used in common for both of signals of said dynamic drive signal and signals of said static drive signal.

* * * * *